US009848638B2

(12) United States Patent
Morgan

(10) Patent No.: US 9,848,638 B2
(45) Date of Patent: Dec. 26, 2017

(54) CIGAR SHAPED SMOKING DEVICE WITH REVERSE CALABASH CHAMBER

(71) Applicant: Christopher D. Morgan, Los Gatos, CA (US)

(72) Inventor: Christopher D. Morgan, Los Gatos, CA (US)

( * ) Notice: Subject to any disclaimer, the term of this patent is extended or adjusted under 35 U.S.C. 154(b) by 592 days.

(21) Appl. No.: 14/470,853

(22) Filed: Aug. 27, 2014

(65) Prior Publication Data

US 2014/0360513 A1 Dec. 11, 2014

Related U.S. Application Data

(63) Continuation-in-part of application No. 13/153,423, filed on Jun. 4, 2011, now abandoned.

(60) Provisional application No. 61/919,563, filed on Dec. 20, 2013.

(51) Int. Cl.
*A24F 1/28* (2006.01)
*A24F 1/32* (2006.01)

(52) U.S. Cl.
CPC . *A24F 1/28* (2013.01); *A24F 1/32* (2013.01)

(58) Field of Classification Search
CPC ..... A24F 1/28
See application file for complete search history.

(56) References Cited

U.S. PATENT DOCUMENTS 2,546,237 A * 3/1951 Rehfeld ..... A24F 1/28 131/182
3,302,651 A * 2/1967 Baker ..... A24F 1/28 131/185
3,565,071 A * 2/1971 Cobb ..... A61M 15/00 128/203.24
3,750,677 A * 8/1973 Jodoin ..... A24F 5/00 131/181
3,804,100 A * 4/1974 Fariello ..... A24F 1/14 131/173
5,678,573 A * 10/1997 Aldin, Sr. ..... A24F 1/24 131/226
5,908,031 A * 6/1999 Clark ..... A24F 1/30 131/173
2003/0217757 A1* 11/2003 Edelmann ..... A24C 1/42 131/360
2006/0016453 A1* 1/2006 Kim ..... A24F 47/008 131/194
2009/0235939 A1* 9/2009 Gonsalves ..... A24D 1/14 131/191

(Continued)

*Primary Examiner* — Eric Yaary
(74) *Attorney, Agent, or Firm* — Stephen E. Zweig

(57) ABSTRACT

A cigar shaped pipe, ideally made from premium materials such as briar, yet designed to be low cost to manufacture. The device uses a comparatively thin-walled combustion chamber, which both keeps material costs to a minimum, as well as an in-line reverse Calabash chamber to reduce the temperature and moisture of the smoke. In some embodiments, the pipe will further use an end cap, ether for pipe storage or during smoking. This optional end-cap will ideally be made of the same materials as the main pipe body, and thus will have similar thermal expansion properties, as well as having the same beneficial combustion chamber properties. This end cap may utilize O-rings or screw threads to hold the pipe's end cap onto position, thus enabling easy loading and cleaning.

16 Claims, 4 Drawing Sheets

(56) References Cited

U.S. PATENT DOCUMENTS

2009/0258117 A1* 10/2009 Lee ..... A24F 1/32
426/104

* cited by examiner

CIGAR SHAPED SMOKING DEVICE WITH REVERSE CALABASH CHAMBER

CROSS REFERENCE TO RELATED APPLICATIONS

This application is a continuation in part of U.S. patent application Ser. No. 13/153,423 "CIGAR SHAPED SMOKING DEVICE", inventor Christopher D. Morgan, filed Jun. 4, 2011; this application also claims the priority benefit of U.S. provisional application 61/919,563 "CIGAR SHAPED SMOKING DEVICE WITH REVERSE CALABASH CHAMBER", inventor Christopher D. Morgan, filed Dec. 20, 2013; the complete contents of both applications are incorporated herein by reference.

BACKGROUND OF THE INVENTION

Field of the Invention

This invention is in the field of smoking pipes and other smoking devices.

Description of the Related Art

Humans have been smoking various burnable substances for thousands of years, and pipes are probably the earliest known method of smoking. These substances, typically tobacco, are commonly smoked by placing them in the bowl of a pipe. This bowl also serves as the burning chamber or combustion chamber. The substance is lit on fire, thereby creating smoke and fumes (e.g. a thermally generated inhalation aerosol) which may then be inhaled.

In contrast to cigarettes and cigars, which completely burn up during the smoking process, and thus are single use devices, smoking pipes can often last for years and indeed many pipes can last for a lifetime if properly cared for.

Traditional pipes generally consist of a bowl (burning chamber, combustion chamber), with an open end that is generally expected to be held in an open end up position when in use. The bowl in turn is generally connected by a thinner hollow airway tube to a mouthpiece.

Because pipes are multiple use devices, the material used for the bowl often has a major impact on the pipe properties when in use. During the burning reaction, the chemistry of the burning process, and the resulting smoke, can be influenced by the bowl, either favorably or unfavorably. Often bowls made from porous heat-resistant materials are favored.

The porous nature of the bowl, as well as the bowl's basic heat conductivity thickness, can have an impact on the overall temperature of the pipe when in operation, helping the user keep the burning temperature in the optimal range. A porous bowl material can also help absorb excess moisture from the smoke. In some pipes, the bowl material may also char in a desirable manner that also positively contributes to the overall flavor of the smoke, and hence to smoking enjoyment. Here often materials such as briar or other dense woods, porous stone such as meerschaum or clay, or other materials such as corncobs may be used. Briar in particular is highly prized, but it is available in only limited quantities. Briar for pipes is obtained from Erica arborea (briar bush) burls. This bush grows only in a few habitats, and the small, ball-sized burls, which form near the base of the tree between the root and the trunk, typically take from 40 to 100 or more years to form, and must be elaborately seasoned and cured before use. These days such briar burls are hard to find.

In contrast to bowls, which are ideally made of porous materials, pipe mouthpieces, which are intended to be placed in the mouth repeatedly over time, are more commonly made from non-porous materials for sanitation and ease of cleaning.

Although the characteristic shape of a common smoking pipe—the upturned bowl, thin stem, mouthpiece, with the bowl often carefully held with one hand while in use, is known by all, other less common pipe designs have also been proposed.

For example, De Benedictis, in U.S. Pat. No. 1,674,617 proposed a cigar shaped pipe with a unique if somewhat complex design intended to perfectly simulate the appearance of a cigar.

Other tubular pipe designs have also been proposed. For example, a type of pipe called a Zeppelin pipe was produced during the 1920s by Vauen, a German pipe manufacturing firm. This pipe, has a streamlined appearance with a characteristic central bulge, thus somewhat resembling a Zeppelin in appearance. The Zeppelin pipe has a metal cap, and generally unscrews down the down the middle for filling and cleaning.

More recently, Erickson, in U.S. Pat. No. 7,350,523, proposed a tobacco smoking pipe with its own unique cigar shaped design, configured to operate by screwing and unscrewing the bowl from the rest of the pipe.

BRIEF SUMMARY OF THE INVENTION

The invention is based, in part, on the insight that pipes, although traditional, have now somewhat gone out of style to the point where a younger person may occasionally feel conspicuous when smoking a pipe in public. Thus, at least in terms of present fashions, a cigar-like form factor is often more socially acceptable for public occasions.

The invention is also based, in part, on the insight that the market for cigars is quite different from the market for pipes—that is the two markets largely address different populations of users, with the cigar market being quite a bit bigger. It is likely, however, that at least an appreciable percentage of cigar users may value the unique experience and flavors available to pipe smokers, if it were not for the form-factor of traditional pipes.

The invention also is based, in part, on the insight that pipe smokers often value the use of materials, such as briar, due to the unique and almost "nutty" flavor that a briar bowl, for example, can impart to the smoking experience. However as previously discussed, briar is available in limited quantities, and is thus extremely expensive. Large and relatively defect-free chunks of briar, suitable for carving large and thick traditional pipe bowls, are particularly difficult to find because briar itself is not overly large, and often may possess internal defects.

The invention is also based, in part, on the insight that the use of metal parts in basically wooden or stone pipes, at least where the metal is exposed to heat, has substantial drawbacks because metal expands and contracts differently from the other pipe materials, and thus can with time cause the pipe to crack.

The invention is also based, in part, on the insight that if the tendency in the pipe making field towards making pipes with very thick bowls, intended for lifetime use, was abandoned in favor of thinner bowl designs with a more limited use lifetime, this trade-off might be commercially acceptable. That is, at the proper price point, a substantial portion of the market, might be willing to accept a competitively priced thinner wall bowl (combustion chamber) design, that has a more limited use lifetime (e.g. on the order of a 300 to 2500 uses).

Thus in one embodiment, the invention may be a cigar shaped pipe, ideally made from premium materials such as briar, yet designed to be low cost to manufacture. The device may use a comparatively thin-walled combustion chamber, which both keeps material costs to a minimum, and also enables a comparatively simple and easy to manufacture design. In a preferred embodiment, the pipe will not use metal parts or clips.

In some embodiments, the pipe may further have an optional end cap that can either be placed over the open end of the combustion chamber during pipe storage when the pipe is not in use, or alternatively may even be placed over the open end of the combustion chamber while the pipe is in use. Particularly for this later embodiment, it will be useful to use an end cap that is made of the same materials as the main pipe body, and thus will have similar thermal expansion properties, as well as having the same beneficial combustion chamber properties. In some embodiments, this end cap may utilize a unique O-ring design to hold the pipe's end cap onto position, thus enabling easy loading and cleaning. In other embodiments, other methods, such as screw thread or snap-in detents may be used. However an O-ring design can help to prevent pipe cracking problems and loose part problems that can otherwise occur (due to differential thermal expansion) when metal parts are used.

The invention thus creates a low-cost pipe, with a cigar-like form factor preferred by modern smokers, which nonetheless delivers a premium smoking experience because the pipe may be based on the finest materials available. The pipe is further designed to be easy to use, load, and clean, as well as to be simple and easy to manufacture.

DETAILED DESCRIPTION OF THE INVENTION

Figure 1:
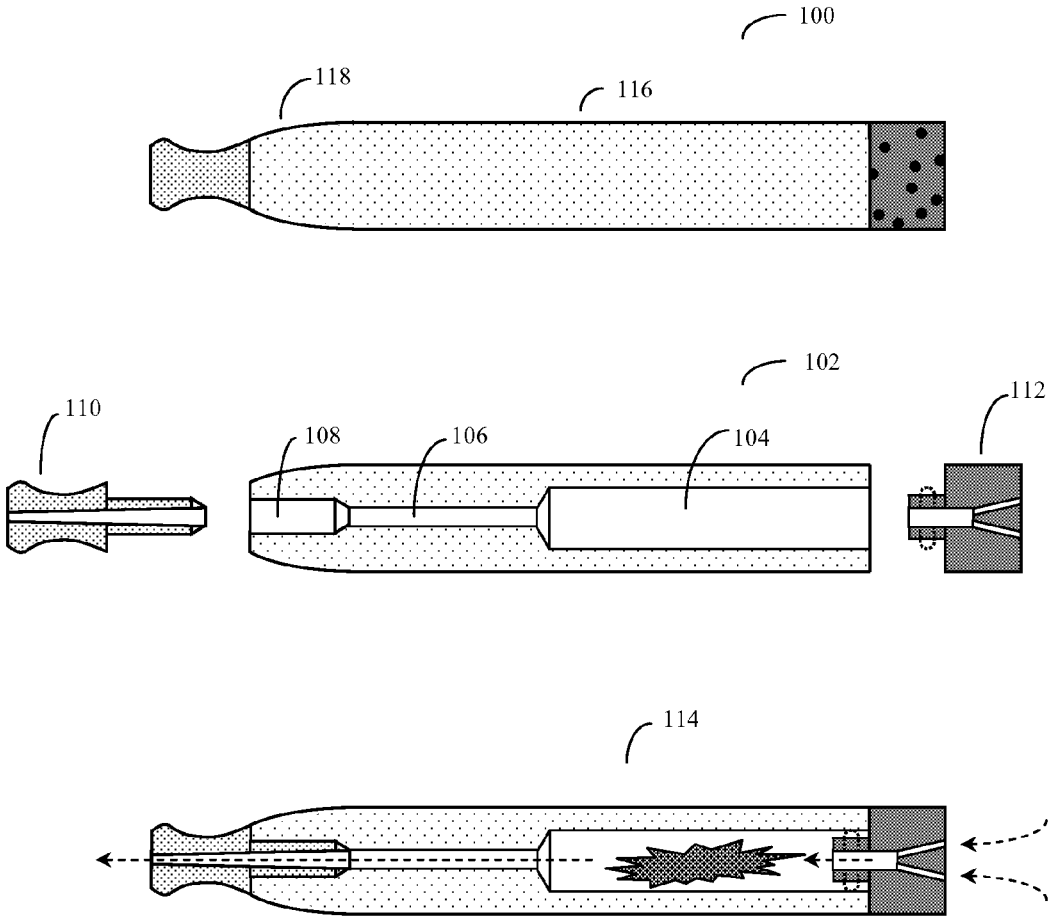
FIG. 1 shows an assembled cigar shaped smoking device, an exploded cross section showing the internal chambers, mouthpiece, and end cap of the device, and the combustion process and air flow that occurs when the device is in use.

In one embodiment, the invention may be a substantially cylindrical smoking pipe, and will often be referred to in this specification in the alternative as a cigar shaped smoking device, device, or pipe. FIG. 1 shows the exterior of an assembled cigar shaped smoking device (100), an exploded cross section (102) showing the internal chambers (104), (106), (108), mouthpiece (110), and optional end cap of the device (112), and the combustion process and air flow that occurs when the device is in use (114).

This pipe will generally comprise a substantially a substantially cylindrical body (116). That is, although the body of the device may deviate somewhat from a true cylinder—it may be textured, and may also have a curved end (118), particularly near the mouthpiece. Thus from a distance, the overall impression of the body of the device, and indeed the device as a whole, will be that it is a roughly cylindrical object.

In a preferred embodiment, the body (116) may be made of a heat resistant porous material, such as briar, or other material such as wood or wood-like natural organic materials (e.g. bog-wood, briar, cherry wood, corncob, olive-wood, maple, mesquite, oak and other woods). Alternatively the body may be made from a porous non-organic material (e.g. catlinite, clay, meerschaum, soapstone and the like).

Figure 2:
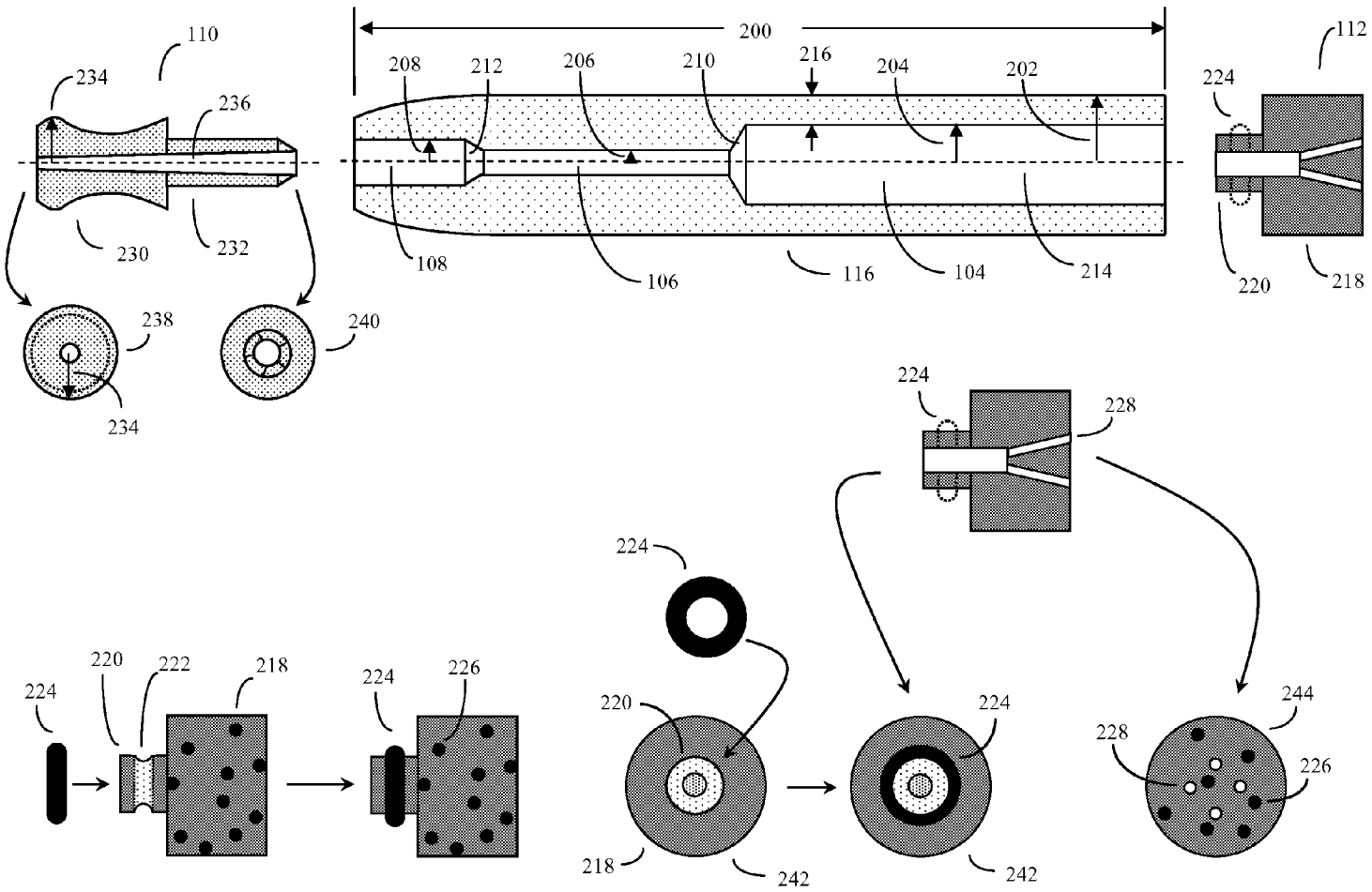
FIG. 2 shows a more detailed close-up of the various portions of the device.

The dimensions of the device are shown in more detail in FIG. 2. The generally cylindrical body (116) will generally have a length (200) and radius (202).

Generally the device will be made in various sizes, and often these sizes will fall within the same size ranges typically used to make small to large sized cigars. Thus the length of the cylindrical portion of the body (200) will generally be between 6 cm and 25 cm, and the radius of the body (202) (here termed the "first radius" or "body radius") will often be between 8 mm and 30 mm.

As previously discussed, the interior of the body (e.g. the various chambers 104, 106, 108) will be hollow—both to accommodate the burning or combustion chamber (104), and also the airway chamber (106) and mouthpiece chamber (108). In general, the interior of the body will be configured into a distal (that is the section of the body towards the cap end (112) that is away from the user's mouth in normal use) and substantially cylindrical burning chamber (104). The interior of this hollow combustion chamber or burning chamber (104) will have a second radius (burning chamber radius) (204). This combustion chamber or burning chamber (104) will be connected to a substantially cylindrical airway chamber (106). The interior of this airway chamber, which itself will usually be cylindrical, will have a third radius (airway radius) (206). The airway chamber in turn will connect to a proximal (i.e. end closer to the user's mouth in normal use), and substantially cylindrical mouthpiece chamber (108) with a fourth radius (mouthpiece chamber radius) (208).

Thus the burning chamber (104) will be connected by a first junction (210) to the airway chamber (106), and the airway chamber (106) in turn will be connected by a second junction (212) to the mouthpiece chamber (108). The burning chamber (104), airway chamber (106), and mouthpiece chamber (108) will generally each have a different radius (204), (206), (208). Although the junction (210) between the burning chamber (104) and the airway chamber (106), as well as the junction (212) between the airway chamber (106) and the mouthpiece chamber (108) may be abrupt (that is, a 90 degree angle), in a preferred embodiment, one or both junctions (210), (212) may be tapered so as to create an angle greater than 90 degrees at the tapered junction, thereby reducing turbulence in the air flow through the pipe, and lowering the amount of moisture condensation at the tapered junction(s). Such condensation is undesirable because it creates a noisy pipe "gurgle", and also can potentially cause an unpleasant taste to be delivered to the user.

In general, the second radius (burning chamber radius) (202) will be larger than the fourth radius (mouthpiece chamber radius) (208), and the fourth radius (mouthpiece chamber radius) (208) will be larger than the third radius (airway radius) (206). The burning chamber (108), airway chamber (106), and mouthpiece chamber (108) will usually all be aligned in a straight line (214) about a common axis.

In a preferred embodiment, the thickness of the device's material (i.e. wall thickness) (216) at the burning chamber (i.e. the difference between the first radius (body radius)

(202) of the device body and the second radius (burning chamber radius) (204) of the burning chamber) will be set to between 2 mm and 6 mm in thickness. This is substantially less than many pipes that are designed for lifetime use, and is done this way in order to maintain the cigar-like shape of the device on the outside, while keeping the dimensions of the internal burning chamber large enough to function adequately. This design also is very efficient in terms of its use of scarce and expensive materials such as briar.

Many useful pipe bowl or burning chamber materials, such as briar, although heat resistant, do burn or char somewhat. Indeed this layer of char acts somewhat as a protective layer, helping to minimize further burn-through on subsequent uses. One consequence of this design decision is that the device, in use, may have a shorter use lifetime (i.e. smaller number of smoking sessions or "burning events) than the average pipe. Here a design life of between 300 to 2500 smoking sessions or burning events may be considered an adequate trade-off in order to produce a low-cost device that nonetheless delivers a premium smoking experience.

The distal end (away from the smoker's mouth) of the body will have an optional attached stepped cylindrical end cap (112). In some embodiments, this end cap will be comprised of the same heat resistant porous material as the main body. Thus, for example if the main body (116) is composed of briar, the end cap (112) may be composed of briar as well.

This end cap (112) will generally comprise a larger diameter distal first cylinder (218), often with a radius substantially similar to the first radius (body radius) (202) of the main body (116). The end cap's first cylinder (218) will then usually step down in radius, often abruptly (i.e. a 90 degree drop) to a proximal side second cylinder (220). This second end cap cylinder (220) will usually have a radius that is at least slightly less than that of the second radius (burning chamber radius) (204) of the burning chamber (104) inside the main body (116). This second end cap cylinder (220) which in some embodiments may have a substantially cylindrical outer indentation (222) configured to hold a deformable O-ring (224). This deformable O-ring (224), if used, will ideally be made of a temperature resistant but at least semi-elastic material such as rubber or silicone, and this O-ring may be mounted in this cylindrical outer indentation (222). Thus when the second cylinder (220) of the end cap (212) is placed into the burning chamber (104), which is on the distal end of the device's body (116), the end cap (112) can be held in place by a friction fit or elastic fit caused by the elastic deformation of the O-ring (224). This friction fit will help affix the end cap to the distal portion (and burning chamber) of the device body. However as previously discussed, other methods to hold the end cap into place may also be used.

Often, for aesthetic purposes (e.g. to make the device more resemble a cigar), least the portion of the end cap (112) that is visible when the end cap is affixed to the body (116) may be rusticated and/or colored darker than the body and optionally may be further given a textured surface so as to at least somewhat resemble the ash surface of a partially smoked cigar. Here various dyes, such as Fiebing's leather dye, available from the Fiebing Company, Milwaukee Wis., may be used to achieve the desired color effect. This optional rusticated or textured surface is represented on some of the representations of the end cap (112) as small circles (226). For clarity, this optional textured surface is not always shown, however.

In some embodiments, the end cap (112) may not be placed onto the end of the pipe during smoking, but instead may be left off of the end of the pipe while the pipe is in use (e.g. while there is burning material in the combustion chamber). Here the end cap may not have any hollow air openings at all, but instead may be used to terminate any combustion in the combustion chamber, and/or help prevent any ash present in the combustion chamber from escaping if the user is not near an ashtray or other ash receptacle. The end cap may also be used to help protect the relatively delicate (thin-walled) combustion chamber during storage and transport as well.

If the end cap is intended to be used during smoking, then the end cap (112) may have at least one (often several or more) hollow air opening(s) (228) that extend from the proximal (smoker side) radius of the second cylinder through at least a portion of the distal first cylinder of the end cap and to the outside, thereby allowing air to flow from outside of the pipe to the burning chamber (104) when the end cap is affixed to the body. However if the end cap is intended to be removed from the device during smoking, then no hollow air opening(s) (228) may be present.

The device will also have a hollow mouthpiece (110), usually made from a separate and preferably non-porous material such as amber, polyoxybenzylmethylenglycolanhydride (Bakelite®), polyoxymethylene (Delrin®), ebonite, Poly(methyl methacrylate) (Lucite®), other plastic polymer, or other material.

This hollow mouthpiece (110) will usually be inserted into the proximal end of the body (116) at the mouthpiece chamber (108), and the end of the mouthpiece (230) will generally protrude past the proximal portion of the device's body. The distal end of the mouthpiece may be beveled in a manner that is complementary to junction (212), thus helping to achieve a good seal between the mouthpiece and the airway chamber (206).

Although the mouthpiece (110) may be affixed to the body by various methods, often the mouthpiece will have a substantially cylindrical tenon portion (232) that is configured to be inserted into the mortise region created by the mouthpiece chamber (108). This thus creates a mortise and tenon type joint that can help hold the mouthpiece in place firmly in the proximal end of the body (116). This basic mortise and tenon type joint can be further supplemented with glue or other binding methods and methods as needed.

The mouthpiece (110) will generally be substantially cylindrical, and may have a maximum sixth radius (mouthpiece radius) (234) that is less than the first radius (body radius) (202). This mouthpiece will generally have a hollow interior (236) that extends from the proximal portion (user mouth end) of the mouthpiece to the distal portion of the mouthpiece. This will create a complete linear airway or air flow passage that extends from at least the proximal end of the mouthpiece to the distal end of the body (116). The airflow passage will then further extend, when the device is in use, from the distal end of the body (116) through the at least one hollow air opening (228) of the end cap (112), and from there to the outside air.

Although the hollow interior of the mouthpiece (236) may be a simple cylinder, in a preferred embodiment, the hollow interior of the mouthpiece may be tapered from a first distal radius that is substantially similar to the third radius (airway radius) (206) of the airway chamber, to a smaller proximal second radius (not shown) that is, for example less than 80% of the third radius (206) of the airway chamber (106).

FIG. 2 also shows alternate views of the mouthpiece (110) from the proximal (user side) (238) and the distal (body side)

(240), these thus represent top (238) and bottom (240) views of the mouthpiece (110) which otherwise is generally shown in cross-section.

Similarly FIG. 2 also shows alternate views of the optional end cap (112) from the proximal (user side (242) and distal side (244). These represent bottom (242) and top (244) views of the end cap (112) which otherwise is generally shown in cross section.

The lengths of the combustion chamber (104), airway chamber (106), and mouthpiece chamber (108) may vary. Generally the sum of these three lengths will be equal to the body length (200). Often the length of the combustion chamber will be between 30 to 70% of the body length, the length of the airway chamber will be between 10 to 65% of the body length, and the length of the mouthpiece chamber will often be between 5 to 20% of the body length. However these limits are only approximate, and in some embodiments the various lengths may fall outside of these limits. In one embodiment, these relative dimensions, in terms of the percent of body length (200), may be approximately as shown in FIG. 2.

Figure 3:
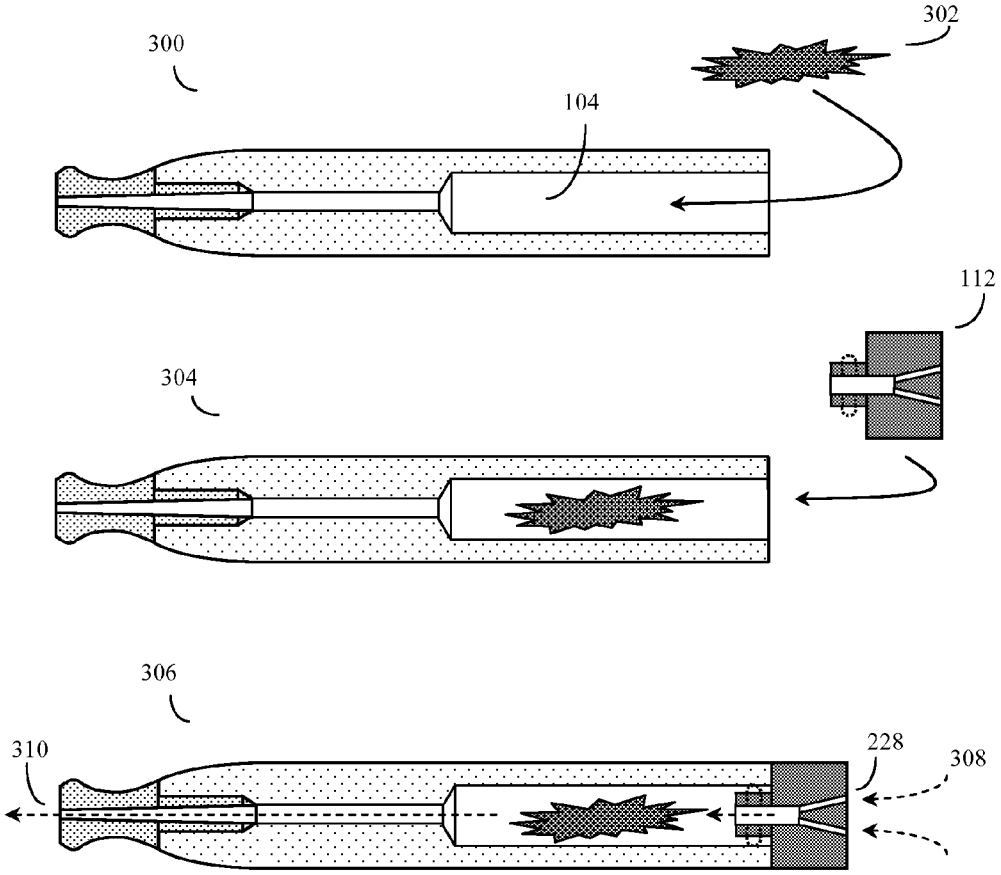
FIG. 3 shows the process of loading the device with smoking material.

FIG. 3 shows the process of loading the device with smoking material. To fill the device (300), the end cap (if present) is removed (by pulling the end cap off), and the smoking material (300) is loaded into the burning chamber (104). Next, the smoking material (302) is lit, and optionally the end cap (112) may be placed into position (304), (306). Alternatively the end cap may be left off of the pipe during smoking. Once into position, a complete airway will be formed where outside air (308) may enter the device either directly into the combustion chamber, or through the at least one air opening in the end cap (228), flow past the combustion chamber or burning chamber (104), through the airway chamber (106), into the mouthpiece chamber (108), through the hollow interior of the mouthpiece (236) and to the user (310).

Figure 4A:
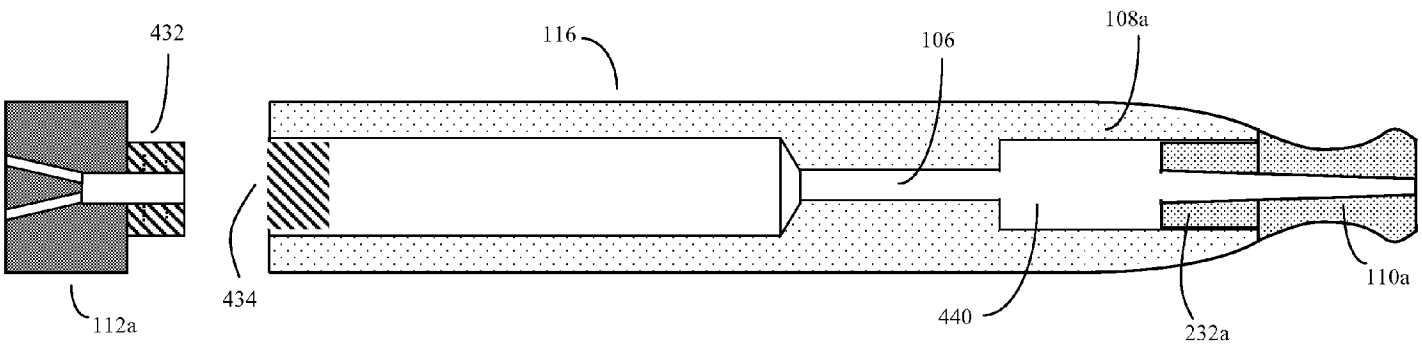
FIG. 4A shows an alternative embodiment with a reverse Calabash Chamber.
Figure 4B:
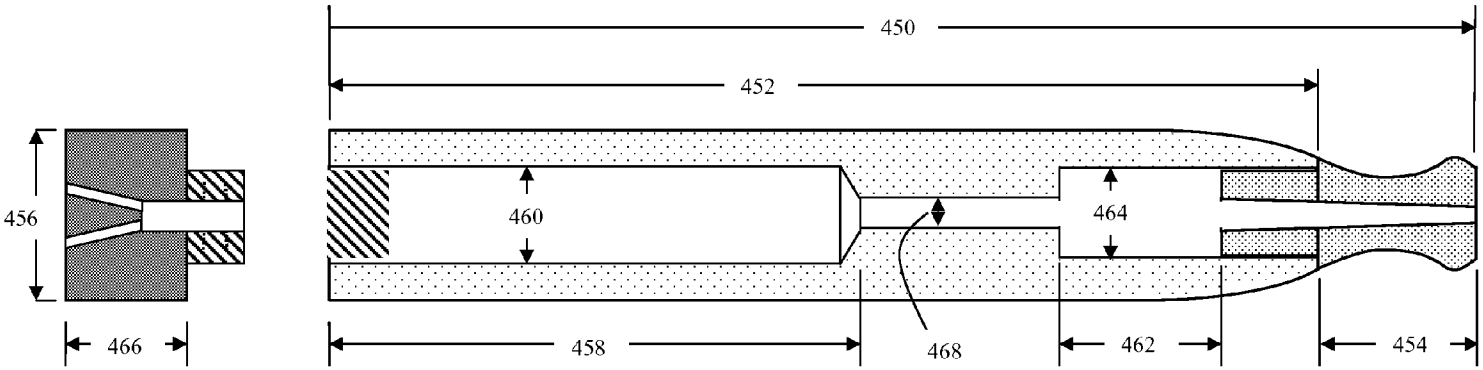
FIG. 4B shows an alternative embodiment with a reverse Calabash Chamber, along with various dimensions of various portions of the device.

FIGS. 4A and 4B show another and preferred embodiment of the invention which features a reverse Calabash chamber. FIG. 4A shows a drawing of this alternative embodiment, while FIG. 4B shows a few possible dimensions of this embodiment.

In this alternative embodiment, the mouthpiece chamber with the fourth radius (108*a*) has a radius that is more than twice the radius of the airway chamber (106), and the length of the cylindrical tenon portion of the mouthpiece (232*a*) is now significantly shorter than the length of the mouthpiece chamber (108*a*), such as to create a gap (440), often with a gap length on the order of 1-4 centimeters (10 to 40 mm, such as 25 mm) between the end of the tenon portion of the mouthpiece (232*a*) and the opposite side of the mouthpiece chamber (108*a*).

The resulting gap (440) essentially creates a "reverse Calabash Chamber". Thus when a smoker applies the proximal end of the mouthpiece chamber to the smoker's lips, and applies negative pressure to the open end of the mouthpiece (e.g. sucks on the end of the pipe); smoke from burning material, after traversing airway chamber (106), then encounters the reverse Calabash chamber (440). The smoke expands, and typically moisture from the smoke then at least partially condenses on the walls of the reverse Calabash chamber. The net effect is to produce a cooler and drier smoke that many smokers find has a preferred flavor and other desirable characteristics. Generally larger Calabash chambers tend to be preferred.

The present design thus produces a unique linear double chambered pipe design in which the combustion chamber is directly in line with the Calabash expansion chamber, and both the axis of the combustion chamber and the Calabash chamber coincide.

FIG. 4B shows some typical dimensions of this embodiment of the device. Neglecting the length of the protruding portion of the cap (112, 112*a*) (450), which will often be between about 5 to 15 mm long, such as about 8 mm long, the thickness of the main portion of the body (116) (452) will often be between about 80 to 14 mm long, such as 95 mm long. The length of the protruding portion of the mouthpiece (110*a*) (454) will often be between about 10 to 30 mm long, such as 19 mm long. The overall diameter (456) (e.g. twice the radius 202) of the cigar (434) and/or cap (112, 112*a*) is typically between about 10 and 30 mm, such as 20 mm. The length of the burning or combustion chamber (104) (458) in this embodiment can be between 30 and 50 mm, such as 40 mm. The internal diameter (e.g. twice the radius 204) of the burning or combustion chamber (104), (460) can be between about 10-20 mm, such as 14 mm. Thus the combustion chamber can often have a volume of between about 2 cubic centimeters and 35 cubic centimeters, such as 12 cubic centimeters, but these limits are only approximate.

The length of the open portion of the reverse Calabash chamber (440), (462) that is not obstructed by the tenon portion (232*a*) of the mouthpiece section (110*a*) can be between about 15 to 35 mm, such as 25 mm. The diameter of the open portion of the reverse Calabash Chamber (440), (464) can be between about 7 to 15 mm, such as 10 mm. Thus the reverse Calabash Chamber will often have a volume of between 0.5 and 6 cubic centimeters, such as about 2 cubic centimeters, but these limits are only approximate.

Thus the relative volume ratios between the combustion chamber and the reverse Calabash chamber can vary from as much as 35/0.5 (70/1) on one extreme as little as 2/6 (1/3) to the other extreme, often around 12/2 (6/1).

The length of the optional protruding cap (112*a*) (466) can be between about 5 to 15 mm, such as about 8 mm. The diameter of the airway chamber (106) (468) (e.g. twice radius 206) can be between about 2 and about 5 mm, such as 3.5 mm.

If the end cap (112*a*) used, in some embodiments, such as the embodiments shown in FIGS. 4A and 4B, instead of using an O-ring (224) to secure the end cap (112*a*) to the body (116), the smaller radius of the end cap (432) can be configured with a screw thread, and the corresponding inner cylinder of the body (434) can be configured with a complementary screw thread, so that the end cap may be screwed into the body (116) (at least after smoking is finished).

Further Discussion:

In a preferred embodiment, the design of the mouthpiece and end cap (110) should be optimized to minimize turbulence. This can be done by keeping the mouthpiece cylindrical or conical. Turbulence is often undesirable in the mouthpiece section, because turbulence causes moisture to precipitate from the smoke and condense on the mouthpiece, which is undesirable. Thus alternative design, such as flat (non-cylindrical) stems are undesirable for this reason.

With regard to any O-Rings such as (224), in a preferred embodiment, these O-Rings will not be made of metal because metal can cause cracking of sensitive materials such as Briar. Rather, any O-Ring that is used should be formed from a deformable and preferably heat-resistant material that can create a snug fit between (112) and the main chamber (104) without the risk of either permanent jamming or subsequent cracking of the wood. Here silicone is a good example of an O-Ring material that has these desirable properties.

In terms of mouthpiece materials, in a preferred embodiment, if synthetic materials are used, acrylic materials are preferred over acetal resins or acetal homopolymer resins (e.g. Delrin®), because acrylic tends to be both more resistant to long term heat exposure, and has less potential for toxicity.

In a preferred embodiment, the wooden (burl) walls of the device (216) are thin (e.g. approximately 2 to 6 mm thick) in order to help dissipate the heat from any burning material in camber (104) before the burl burns. This helps to make the device a relatively durable device capable of a large number of repeat uses.

Delrin® is a Dupont registered trademark. Lexan® is a registered trademark of GE Plastics, now SABIC Innovative Plastics.

The invention claimed is:

1. A substantially cylindrical smoking pipe, said pipe comprising: a substantially cylindrical body comprised of a heat resistant porous material, said body having a first radius; said pipe further comprising a distal position and a proximal position; said body being hollow, an interior of said body being configured into a distal position substantially cylindrical burning chamber with a second radius, a substantially cylindrical airway chamber with a third radius, and a proximal position substantially cylindrical mouthpiece chamber with a fourth radius; said burning chamber being connected by a first junction to said airway chamber, said airway chamber being connected by a second junction to said mouthpiece chamber; said second radius being larger than said fourth radius, and said fourth radius being larger than said third radius; a hollow mouthpiece inserted a the proximal position end of said mouthpiece chamber, and protruding past a proximal position portion of said body, said mouthpiece comprising a substantially cylindrical tenon portion configured to be partially inserted into a mortise region created by said mouthpiece chamber, thereby creating both a mortise and tenon joint that helps hold said mouthpiece in place in said body, as well as a gap between said mouthpiece and said airway chamber that acts as a reverse Calabash chamber with a volume of between 0.5 and 6 cubic centimeters, allowing smoke from material burning in said burning chamber to expand, and moisture in said smoke to condense on walls of said mouthpiece chamber; said burning chamber, said airway chamber, said reverse Calabash chamber, and said mouthpiece chamber all being aligned in a straight line about a common axis; said mouthpiece being substantially cylindrical, and having a maximum sixth radius that is less than said first radius; said mouthpiece having a hollow interior extending from a proximal position portion of said mouthpiece to a distal position portion of said mouthpiece, so that a linear airway extends from at least said proximal position end of said mouthpiece to a distal position end of said body, and from a distal position end of said body; said pipe further comprising a removable stepped cylindrical end cap, said end cap comprised of a distal position first cylinder with a radius substantially similar to said first radius, said first cylinder stepping down in radius to a proximal position second cylinder with a radius that is less than said second radius, wherein said second cylinder further comprises a cylindrical outer indentation configured to hold a deformable O-ring, a deformable O-ring being mounted in said cylindrical outer indentation; said deformable O-ring comprised of a heat resistant deformable material, so that when said second cylinder is placed in the distal position end of said body, said end cap is held in place by a friction fit caused by the elastic deformation of said O-ring, thereby affixing said end cap to the distal position portion of said body.

2. The pipe of claim 1, wherein said heat resistant porous material is selected from any of the group consisting of wood or wood-like natural organic materials consisting of bog-wood, briar, cherrywood, corncob, olivewood, maple, mesquite, oak and other woods.

3. The pipe of claim 1, wherein said heat resistant porous material is selected from the group consisting of porous non-organic materials consisting of catlinite, clay, meerschaum, and soapstone.

4. The pipe of claim 1, wherein said mouthpiece is made of a material selected from the group consisting of amber, polyoxybenzylmethylenglycolanhydride (Bakelite), polyoxymethylene (Delrin), ebonite, Poly(methyl methacrylate) (Lucite), or other plastic polymer.

5. The pipe of claim 1, wherein at least the portion of said end cap visible when said end cap is affixed to said body is colored darker than said body and further has a textured surface so as to resemble an ash surface of a partially smoked cigar; and wherein said end cap is comprised of the same heat resistant porous material as the body of said pipe.

6. The pipe of claim 1, wherein said end cap further comprises at least one hollow air opening that extends from the proximal position radius of said second cylinder through at least a portion of the distal position first cylinder of said end cap and to the outside, thereby allowing air to flow from outside said pipe to said burning chamber when said end cap is affixed to said body.

7. The pipe of claim 1, wherein said first junction and said second junction are tapered so as to create an angle greater than 90 degrees at said junction, thereby reducing turbulence in air flow through said pipe and lowering an amount of moisture condensation at said junctions.

8. The pipe of claim 1, wherein the hollow interior of said mouthpiece is tapered from a first distal position radius substantially similar to said third radius of said airway, to a smaller proximal position second radius that is less than 80% of said third radius of said airway.

9. The pipe of claim 2, wherein a thickness of said material at said burning chamber, said thickness being a difference between said first radius of said body and said second radius of said burning chamber, is between 2 mm and 6 mm.

10. The pipe of claim 9, wherein said material and said thickness of said material are chosen so as to produce a pipe with a burning chamber capable of between 300 and 2500 burning events before burn-through.

11. The pipe of claim 1, wherein the length of said body is between 6 cm and 25 cm, and the radius of said body is between 8 mm and 30 mm.

12. A method of reducing the temperature and moisture content of smoke produced by a substantially cylindrical smoking pipe, said method comprising: obtaining a substantially cylindrical smoking pipe comprising: a substantially cylindrical body comprised of a heat resistant porous material, said body having a first radius; said pipe further comprising a distal portion and a proximal portion; said body being hollow, an interior of said body being configured into a distal position and substantially cylindrical burning chamber with a second radius, a substantially cylindrical airway chamber with a third radius, and a proximal position substantially cylindrical mouthpiece chamber with a fourth radius; said burning chamber being connected by a first junction to said airway chamber, said airway chamber being connected by a second junction to said mouthpiece chamber; said second radius being larger than said fourth radius, and said fourth radius being larger than said third radius; a hollow mouthpiece inserted into a proximal position end of said mouthpiece chamber, and protruding past a proximal position portion of said body, said mouthpiece comprising a substantially cylindrical tenon portion configured to be partially inserted into a mortise region created by said mouthpiece chamber, thereby creating both a mortise and tenon joint that helps hold said mouthpiece in place in said body, as well as a gap between said mouthpiece and said airway chamber that acts as a reverse Calabash chamber with a volume of between 0.5 and 6 cubic centimeters; said burning chamber, said airway chamber, said reverse Calabash chamber and said mouthpiece chamber all being aligned in a straight line about a common axis; said mouthpiece being substantially cylindrical, and having a maximum sixth radius that is less than said first radius; said mouthpiece having a hollow interior extending from a proximal position portion of said mouthpiece to a distal position portion of said mouthpiece, so that a linear airway extends from at least said proximal position end of said mouthpiece to a distal position end of said body, and from the distal end of said body; said pipe further comprising a removable stepped cylindrical end cap, said end cap comprised of a distal position first cylinder with a radius substantially similar to said first radius, said first cylinder stepping down in radius to a proximal position second cylinder with a radius that is less than said second radius, wherein said second cylinder further comprises a cylindrical outer indentation configured to hold a deformable O-ring, a deformable O-ring being mounted in said cylindrical outer indentation; said deformable O-ring comprised of a heat resistant deformable material, so that when said second cylinder is placed in the distal position end of said body, said end cap is held in place by a friction fit caused by the elastic deformation of said O-ring, thereby affixing said end cap to the distal position portion of said body; placing a burnable substance in said substantially cylindrical burning chamber, and lighting said substance on fire thereby producing high temperature smoke containing moisture from said burnable substance; applying negative pressure to said hollow mouthpiece; wherein, when smoke produced by said burnable substance is drawn by said negative pressure into said reverse Calabash chamber, said smoke expands and cools in temperature, and moisture in said smoke condenses on the walls of said reverse Calabash chamber, thereby reducing the temperature and moisture of said smoke.

13. The method of claim 12, wherein said material is briar, and wherein a thickness of said material is chosen so as to produce a pipe with a burning chamber capable of between 300 and 2500 burning events before burn-through;

wherein the length of said body is between 6 cm and 25 cm, and the radius of said body is between 8 mm and 30 mm;

and wherein said reverse Calabash chamber has an open portion with a minimum length of 15 mm and a maximum length of 35 mm, and a minimum diameter of 7 mm and a maximum diameter of 15 mm.

14. A method of reducing the temperature and moisture content of smoke produced by a substantially cylindrical smoking pipe, said method comprising: obtaining a substantially cylindrical smoking pipe comprising: a substantially cylindrical body comprised of a heat resistant porous material, said body having a first radius; said pipe further comprising a distal portion and a proximal portion; said body being hollow, an interior of said body being configured into a distal position and substantially cylindrical burning chamber with a second radius, a substantially cylindrical airway chamber with a third radius, and a proximal position substantially cylindrical mouthpiece chamber with a fourth radius; said burning chamber being connected by a first junction to said airway chamber, said airway chamber being connected by a second junction to said mouthpiece chamber; said second radius being larger than said fourth radius, and said fourth radius being larger than said third radius; a hollow mouthpiece inserted into a proximal position end of said mouthpiece chamber, and protruding past a proximal position portion of said body, said mouthpiece comprising a substantially cylindrical tenon portion configured to be partially inserted into a mortise region created by said mouthpiece chamber, thereby creating both a mortise and tenon joint that helps hold said mouthpiece in place in said body, as well as a gap between said mouthpiece and said airway chamber that acts as a reverse Calabash chamber with a volume of between 0.5 and 6 cubic centimeters; said burning chamber, said airway chamber, said reverse Calabash chamber and said mouthpiece chamber all being aligned in a straight line about a common axis; said mouthpiece being substantially cylindrical, and having a maximum sixth radius that is less than said first radius; said mouthpiece having a hollow interior extending from a proximal position portion of said mouthpiece to a distal position portion of said mouthpiece, so that a linear airway extends from at least said proximal position end of said mouthpiece to a distal position end of said body, and from a distal position end of said body through at least one hollow air opening of an end cap to the outside; wherein said material is briar, and wherein a thickness of said material is chosen so as to produce a pipe with a burning chamber capable of between 50 and 1000 burning events before burn-through; wherein the length of said body is between 6 cm and 25 cm, and the radius of said body is between 8 mm and 30 mm; and wherein said reverse Calabash chamber has an open portion with a minimum length of 15 mm and a maximum length of 35 mm, and a minimum diameter of 7 mm and a maximum diameter of 15 mm; placing a burnable substance in said substantially cylindrical burning chamber, and lighting said substance on fire, thereby producing high temperature smoke containing moisture from said burnable substance; after lighting said substance on fire, applying a removably stepped cylindrical end cap to seal at least one end of said substantially cylindrical burning chamber, said end cap comprised of a distal position first cylinder with a radius substantially similar to said first radius, said first cylinder stepping down in radius to a proximal position second cylinder with a radius that is less than said second radius; wherein said second cylinder further comprises a cylindrical outer indentation configured to hold a deformable O-ring, a deformable O-ring being mounted in said cylindrical outer indentation; said deformable O-ring comprised of a heat resistant deformable material, so that when said second cylinder is placed in the distal position end of said body, said end cap is held in place by a friction fit caused by the elastic deformation of said O-ring, thereby affixing said end cap to the distal position portion of said body; said end cap further comprising at least one hollow air opening that extends from a proximal position radius of said second cylinder through at least a portion of the distal position first cylinder of said end cap and to the outside, thereby allowing air to flow from outside said pipe to said burning chamber when said end cap is affixed to said body; applying negative pressure to said hollow mouthpiece; wherein, when smoke produced by said burnable substance is drawn by said negative pressure into said reverse Calabash chamber, said smoke expands and cools in temperature, and moisture in said smoke condenses on the walls of said reverse Calabash chamber, thereby reducing the temperature and moisture of said smoke.

15. The pipe of claim 1, wherein said reverse calabash chamber has a volume of between 2 and 6 cubic centimeters.

16. The pipe of claim 12, wherein said reverse calabash chamber has a volume of between 2 and 6 cubic centimeters.

* * * * *